US010801805B1

(12) United States Patent
Hu

(10) Patent No.: US 10,801,805 B1
(45) Date of Patent: Oct. 13, 2020

(54) AIR FLOW ADJUSTING DEVICE OF AIR GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 16/726,255

(22) Filed: Dec. 24, 2019

(30) Foreign Application Priority Data

Nov. 13, 2019 (TW) ..... 108215017 U

(51) Int. Cl.
*F41B 11/723* (2013.01)

(52) U.S. Cl.
CPC ..... *F41B 11/723* (2013.01)

(58) Field of Classification Search
CPC ..... F41B 11/723; F41B 11/722; F41B 11/72
USPC ..... 124/73, 76
See application file for complete search history.

(56) References Cited

U.S. PATENT DOCUMENTS

2011/0146647 A1* 6/2011 Hu ..... F41B 11/723 124/76
2015/0013656 A1* 1/2015 Priestley ..... F42B 6/10 124/74
2017/0153081 A1* 6/2017 Hu ..... F41B 11/642

* cited by examiner

*Primary Examiner* — Reginald S Tillman, Jr.
(74) *Attorney, Agent, or Firm* — Raymond Y. Chan; David and Raymond Patent Firm

(57) ABSTRACT

An air flow adjusting device of air gun includes an adjusting assembly having an adjusting knob and a locking seat; a piston sleeve provided with a rod body inserted into the locking seat and threaded with the adjusting knob; a spring arranged between the locking seat and a base of the rod body. One end of the adjusting knob is locked to the locking seat. By rotating the adjusting knob, the relative locking position of the adjusting knob and the locking seat can be changed, and the total length of the piston sleeve and the adjusting assembly can be adjusted; thereby, the adjusting knob can be rotated by to defining a slot in the piston seat, and the function of adjusting the air flow rate can be achieved without using any tool, so that the operation of adjusting the air flow can be simplified, which improves the operational convenience of the device.

4 Claims, 6 Drawing Sheets

AIR FLOW ADJUSTING DEVICE OF AIR GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an air flow adjusting device of air gun, and more particularly to an air flow adjusting device of air gun, which can adjust the air flow rate by operating an adjusting knob inside a piston seat from the outside of the piston seat without any tool.

Description of Related Arts

Most air guns nowadays use gas as the firing force of the bullet (commonly known as BB bomb), but in the intake structure of the conventional air gun, the gas flow rate of each firing stays the same; that is, the moving distance of an air separation valve (elastic plug block of the present invention) is fixed, so that the initial firing speed is stable. However, in view of different play methods and different needs of the users, air guns have appeared under the innovation of the industry to adjust different gas flow rate, but after many repeated fires, it is inevitable that the initial firing speed after adjustment will change due to vibration. In view of this, some improved air gun was invented, such as TW Pat. No. M534812, which tried to solve some of the issues.

The present invention mitigates and/or obviates the aforementioned disadvantages.

SUMMARY OF THE PRESENT INVENTION

The primary objective of the present invention is to provide an air flow adjusting device of air gun which can solve the drawbacks of conventional technologies, especially in adjusting the initial firing speed.

The air flow adjusting device of air gun of the present invention comprises a piston seat, a piston sleeve and an adjusting assembly. The piston seat is internally defined with an air flow channel having an air inlet at a lower part thereof and an elastic plug block corresponding to the air inlet. The two sides of the air flow channel are respectively an air outlet and a closed opening. The piston sleeve has an end head at one end thereof and a rod body at the other end thereof. The rod body is inserted into the air flow channel via the closed opening, and the end head is located outside the closed opening. The rod body has a base and an external threaded portion. The adjusting assembly is located in the air flow channel of the piston seat and is connected between the rod body of the piston sleeve and the elastic plug block. It is characterized in that: the adjusting assembly is provided with an adjusting knob having an internal threaded portion and a locking seat for insertion of the rod body. The external threaded portion of the rod body is threaded with the internal threaded portion of the adjusting knob. A spring is provided between the locking seat and the base of the rod body. One end of the adjusting knob is locked to the locking seat. By rotating the adjusting knob, the locking position of the adjusting knob and the locking seat can be changed relatively, and the total length of the piston sleeve and the adjusting assembly can be adjusted; that is, the stroke position of the elastic plug block can be adjusted, so as to adjust the air flow rate.

The adjusting knob has a wiping portion provided on the surface thereof, and the piston seat is defined with at least one slot corresponding to the wiping portion, so that the adjusting knob can be rotated only by operating the wiping portion only with finger(s) via the slot.

In addition, the adjusting knob has a plurality of concave teeth arranged thereon relative to the end surface of the locking seat, and the locking seat correspondingly has at least one protruding tooth arranged thereon. The elasticity of the spring makes the protruding tooth engaged with the concave teeth so as to lock the adjusting knob in the locking seat. When rotating the adjusting knob, the protruding tooth can be changed and engaged with a different concave tooth.

Moreover, it is preferably to provide two symmetrical protruding teeth.

Therefore, it can be seen that the present invention is able to adjust the air flow rate by operating the wiping portion of the adjusting knob only with finger(s) via the slot, which solves the drawbacks of the operation of conventional technologies.

The present invention will become more obvious from the following description when taken in connection with the accompanying drawings, which show, for purpose of illustrations only, the preferred embodiments in accordance with the present invention.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments in the following descriptions are to give examples only. Those skilled in the art can think of other obvious modifications. The general principles defined in the following description would be applied to other embodiments, alternatives, modifications, equivalents, and applications without departing from the spirit and scope of the present invention.

Figure 1:
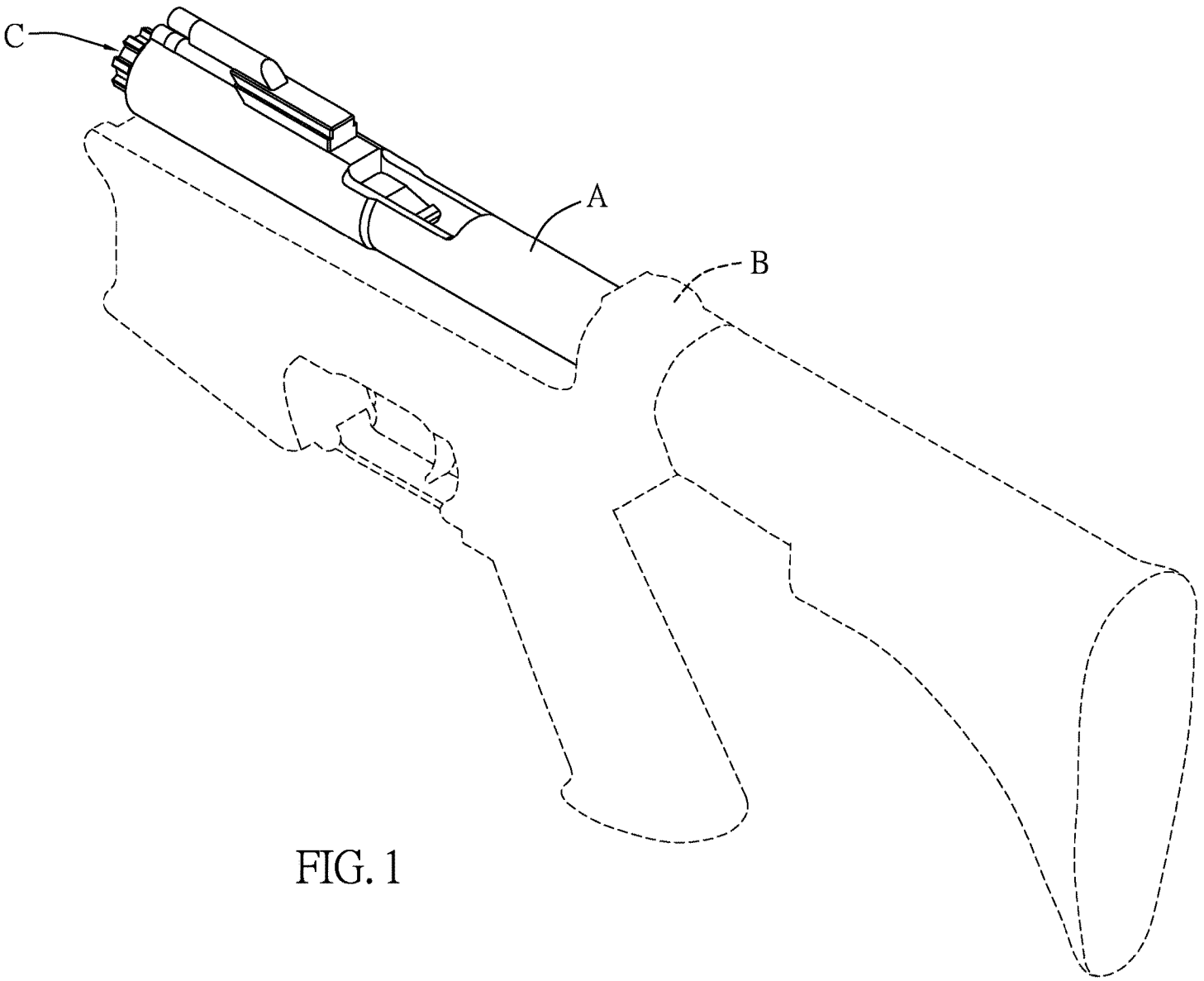
FIG. 1 is a perspective view of an air flow adjusting device of air gun in accordance with the present invention.

Referring to FIG. 1, an air gun in accordance with the present invention comprises a housing A axially inserted through a gun body B, an air flow adjusting device C is inserted through the housing A. The air flow adjusting device C (as shown in FIG. 2) is provided with a piston seat 1, a piston sleeve 2 and an adjusting assembly 3.

Figure 2:
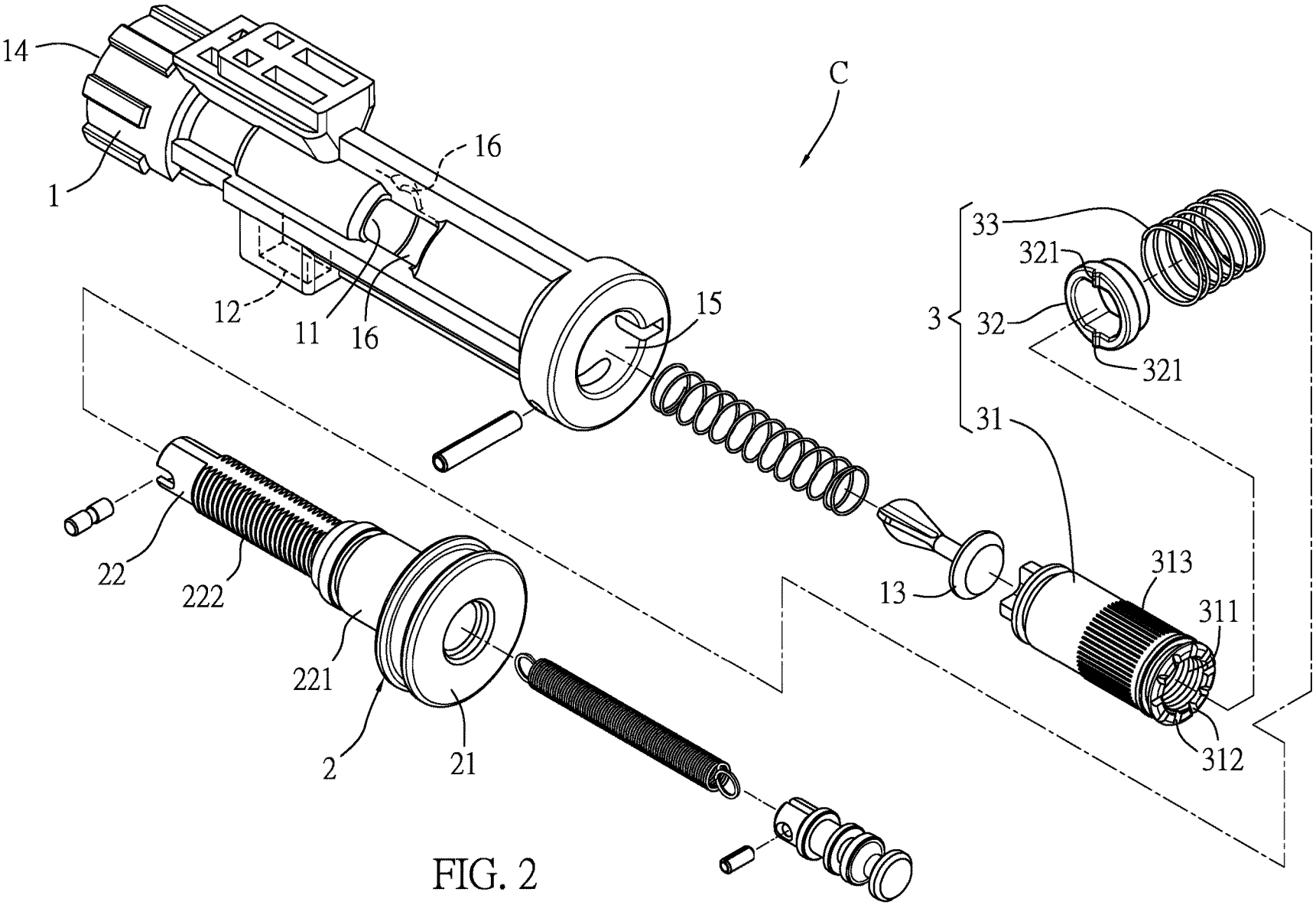
FIG. 2 is an exploded view of the air flow adjusting device of air gun in accordance with the present invention.
Figure 3:
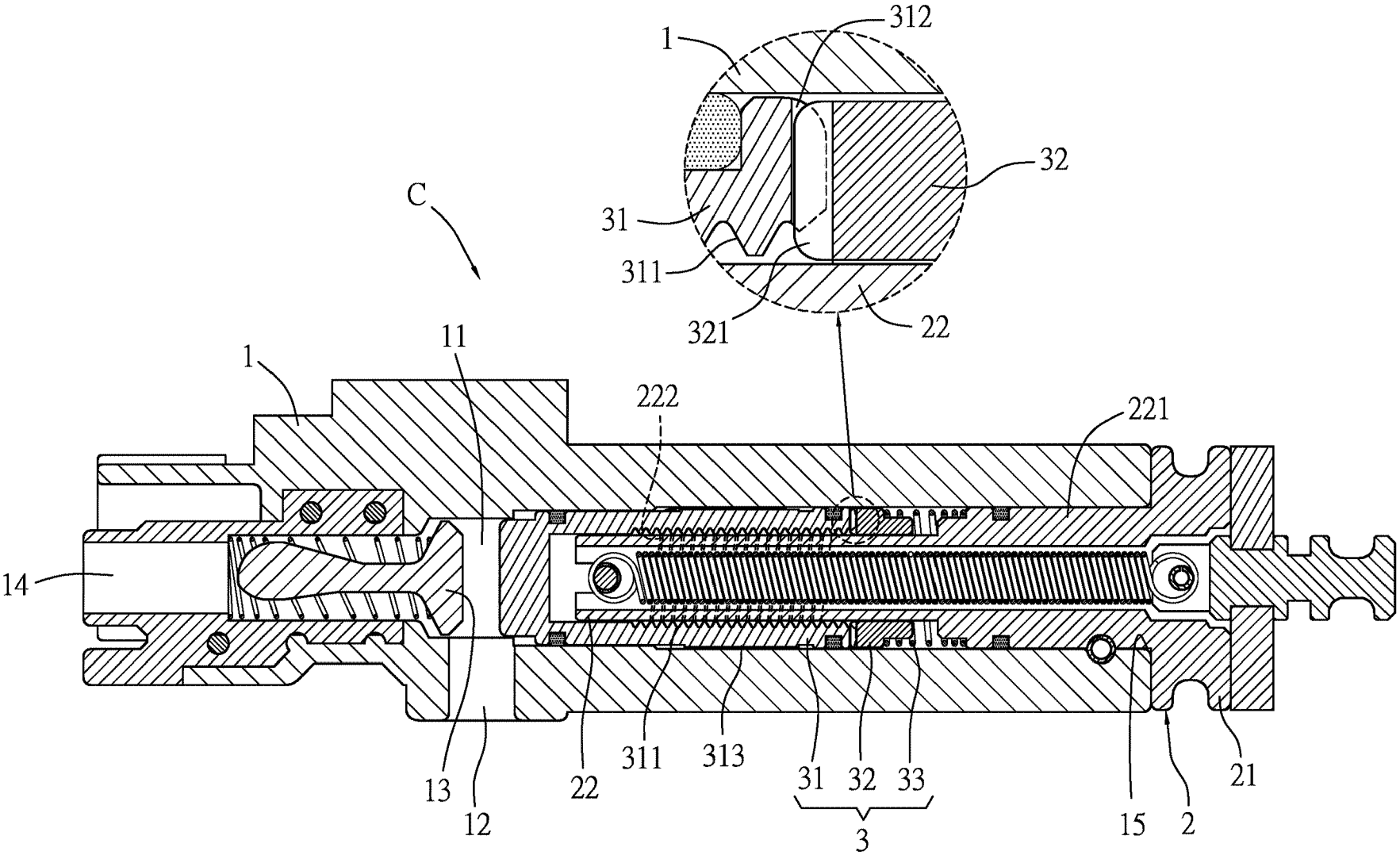
FIG. 3 is an assembly cross sectional and partial amplified view of the air flow adjusting device of air gun in accordance with the present invention.
Figure 6:
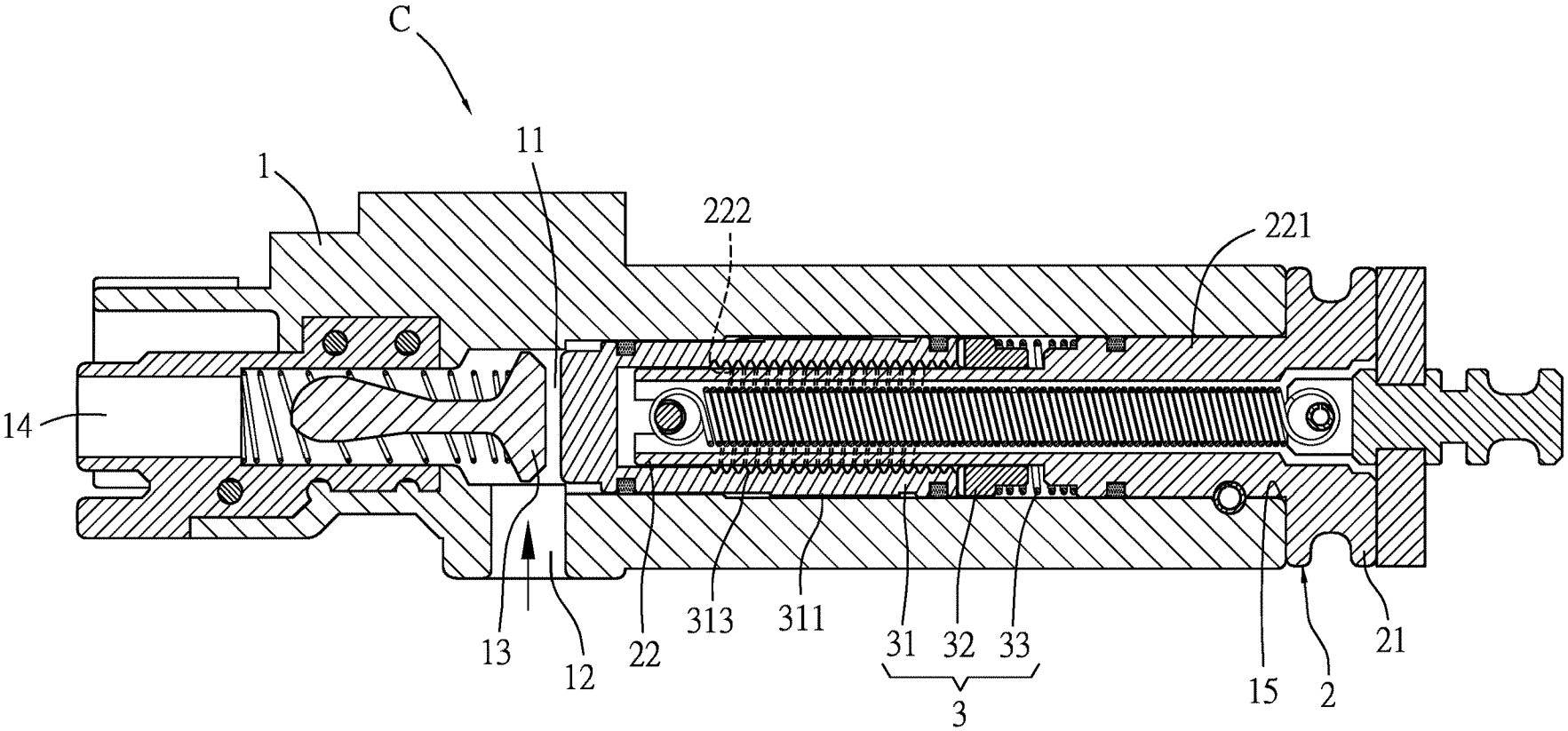
FIG. 6 is a structural cross sectional view when the total length of a piston lining and an adjusting assembly becomes shorter in accordance with the present invention.
Figure 7:
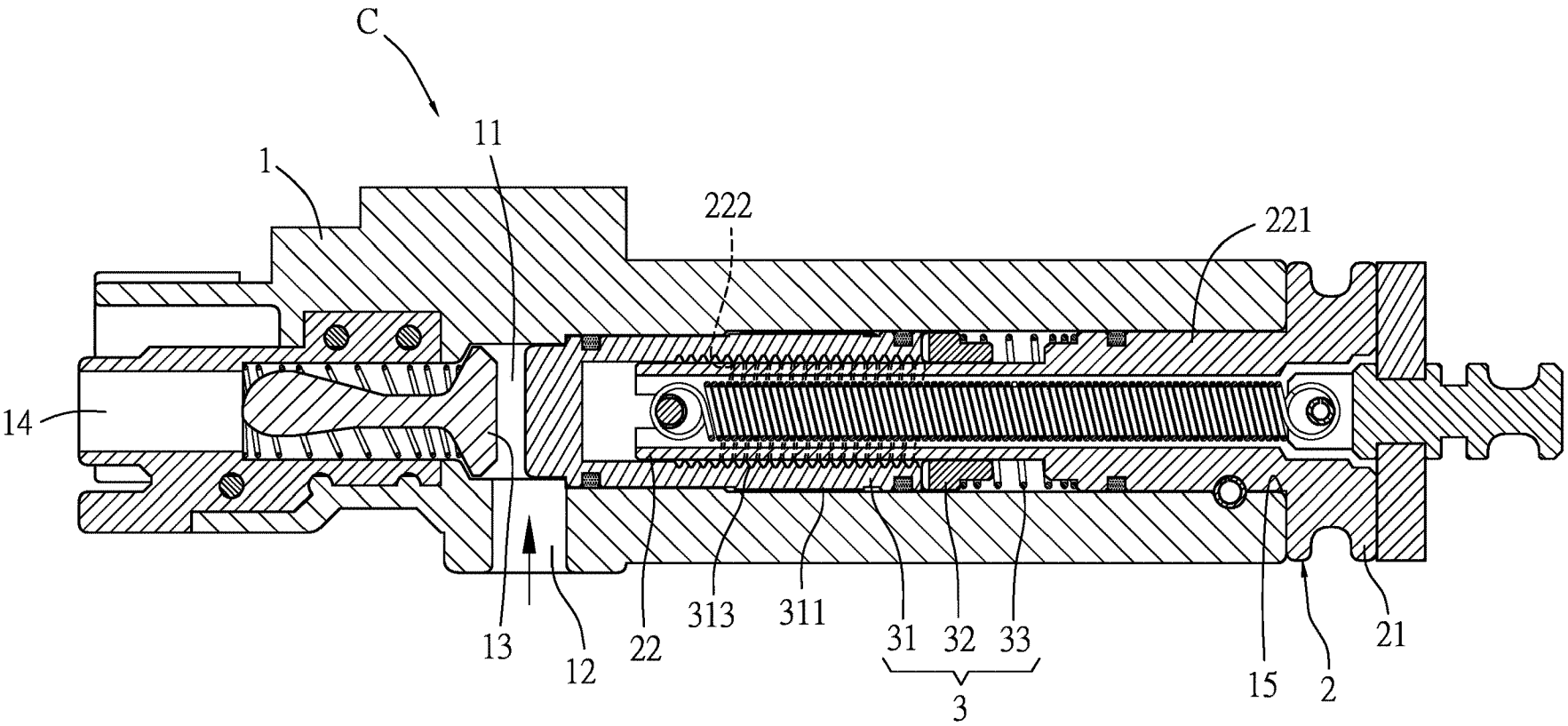
FIG. 7 is a structural cross sectional view when the total length of the piston lining and the adjusting assembly becomes longer in accordance with the present invention.

The piston seat 1 (as shown in FIG. 2) is internally defined with an air flow channel 11 having an air inlet 12 at a lower part thereof and an elastic plug block 13. When the elastic plug block 13 moves to the air inlet 12 (as shown in FIGS. 3, 6 and 7), the function of air separation valve is formed to regulate the flow direction and the rate of the air flow. The two sides of the air flow channel 11 are respectively an air outlet 14 and a closed opening 15. The piston seat 1 has at least one slot 16 arranged thereon in communication with the air flow channel 11 (FIGS. 2 and 5 take the two slots as an example).

The piston sleeve 2 (as shown in FIG. 2) has an end head 21 at one end thereof and a rod body 22 at the other end thereof. The rod body 22 is inserted into the air flow channel 11 via the closed opening 15, and the end head 21 is located outside the closed opening 15 (as shown in FIG. 3). The rod body 22 has a base 221 and an external threaded portion 222.

Figure 4:
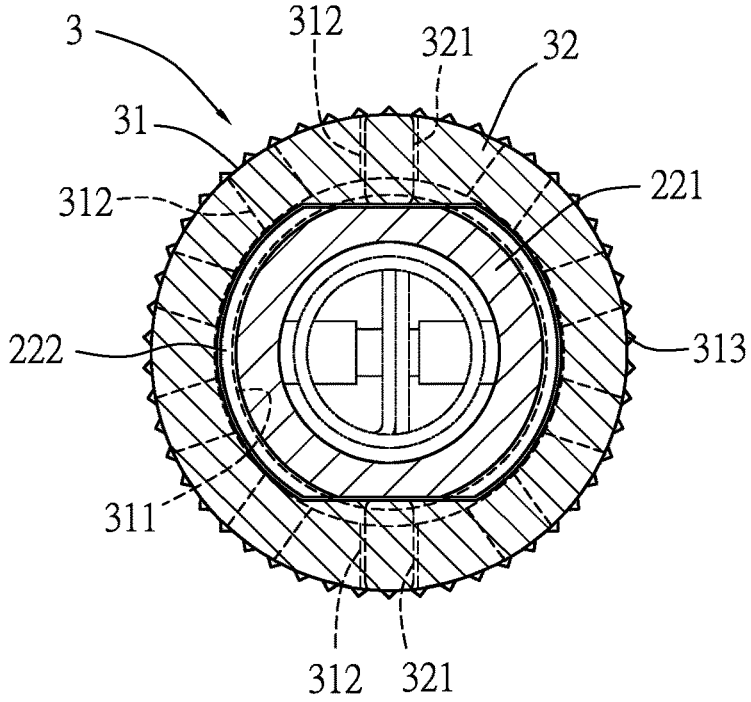
FIG. 4 is a plan view of an engaging state of an adjusting knob and a locking seat in accordance with the present invention.

The adjusting assembly 3 (as shown in FIG. 2) is located in the air flow channel 11 of the piston seat 1 and is connected between the rod body 22 of the piston sleeve 2 and the elastic plug block 13. The adjusting assembly 3 is provided with an adjusting knob 31 having an internal threaded portion 311 and a locking seat 32 for insertion of the rod body 22. The external threaded portion 222 of the rod body 22 is threaded with the internal threaded portion 311 of the adjusting knob 31 (as shown in FIG. 3). In addition, a spring 33 is provided between the locking seat 32 and the base 221 of the rod body 22 for maintaining the elastic force of the locking seat 32 against the adjusting knob (as shown in FIG. 3). The adjusting knob 31 has a plurality of concave teeth 312 arranged thereon relative to the end surface of the locking seat 32, and the locking seat 32 correspondingly has at least one protruding tooth 321 (preferably, two symmetrical protruding teeth, as shown in FIG. 2). The elasticity of the spring 33 makes the protruding tooth 321 engaged with the concave teeth 312 so as to lock the adjusting knob 31 in the locking seat 32 (as shown in FIGS. 3 and 4). When rotating the adjusting knob 31, the protruding teeth 321 can be changed and engaged with different concave teeth 312. Namely, the rotation of the adjusting knob 31 can change the relative locking position of the adjusting knob 31 and the locking seat 32, and the internal threaded portion 311 of the adjusting knob 31 will be spirally moved to the external threaded portion 222 of the rod body 22, so as to adjust the total length of the piston sleeve 2 and the adjusting assembly 3. That is, the stroke position of the elastic plug block 13 can be adjusted, so as to adjust the air flow rate. If the total length becomes longer (please compare FIGS. 3 and 7), after the air flow enters the piston seat 1 from the air inlet 12, the distance at which the elastic plug block 13 moves in the air flow channel 11 will be shortened, so that the air flow through the air flow channel 11 will be less, and the initial speed provided will be slower. On the contrary, if the total length becomes shorter (please compare FIGS. 3 and 6), after the air flow enters the piston seat 1 from the air inlet 12, the distance at which the elastic plug block 13 moves in the air flow channel 11 will be increased, so that there will be more air flow passing through the air flow channel 11, and the initial speed provided will be faster.

Figure 5:
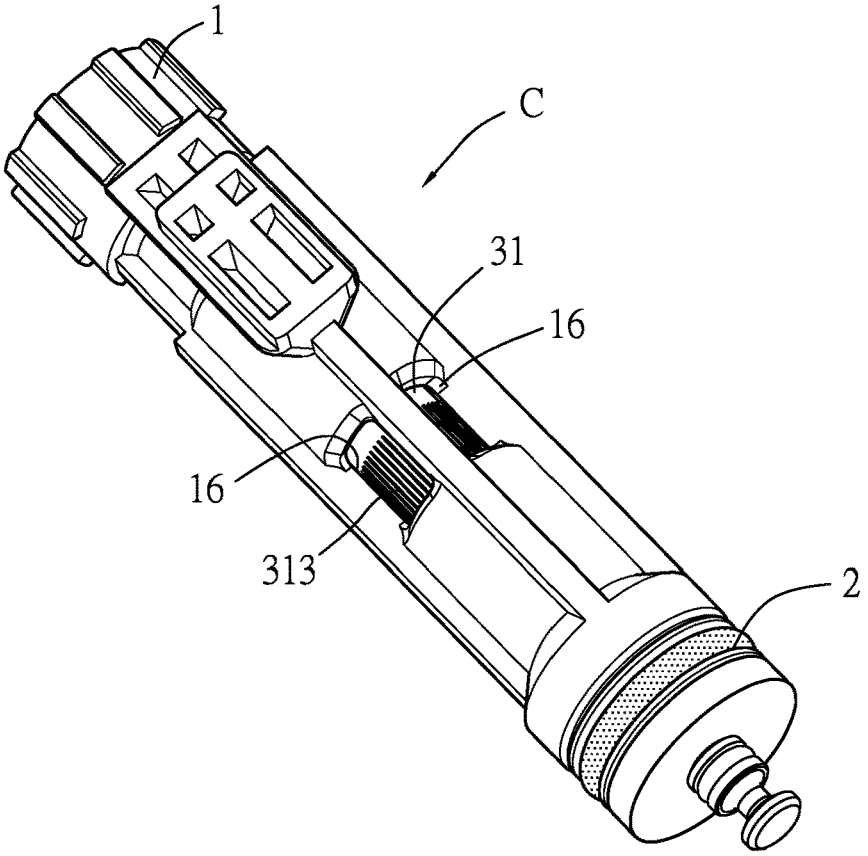
FIG. 5 is an assembly view of the air flow adjusting device of air gun in accordance with the present invention.

The adjusting knob 31 comprises a wiping portion 313 arranged on the surface thereof, and the slot 16 of the piston seat 1 is adapted to correspond to the wiping portion 313 (as shown in FIGS. 2 and 5), so that the adjusting knob 31 can be rotated by operating the wiping portion 313 only with finger(s) via the slot 16.

By the above-mentioned arrangements, the initial firing speed is determined by the air flow rate. When the initial firing speed is adjusted (that is, when the air flow rate is adjusted), as long as the air flow adjusting device C is drawn a distance from the housing A (as shown in FIG. 1, but the air flow adjusting device is not shown in FIG. 1), the adjusting knob 31 can be rotated only by operating the wiping portion 313 by the finger via the slot 16 (as shown in FIG. 5). When the adjusting knob 31 is rotated, the total length of the piston sleeve 2 and the adjusting assembly 3 will be changed (as shown in FIGS. 3, 6 and 7). Then, the stroke position of the elastic plug block 13 relative to the air inlet 12 in the air flow channel 11 will be changed, such that the function of adjusting the air flow rate can be achieved. In contrast to conventional technologies which must rely on special tools to adjust the air flow rate, the operation of the present invention that may be conducted only with finger(s) is more accessible, user-friendly, and efficient.

According to the above-mentioned structure, it can be seen that the present invention allows the user to adjust the initial firing speed by operating the wiping portion 313 only with fingers, which avoids the drawbacks rendered by the requirements of tool operations for the conventional technologies.

While we have shown and described various embodiments in accordance with the present invention, it should be clear to those skilled in the art that further embodiments may be made without departing from the scope of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air flow adjusting device of air gun, comprising:

a piston seat having an air flow channel arranged thereon, which has an air inlet at a lower part thereof, an elastic plug block corresponding to said air inlet, and a closed opening;

a piston sleeve having an end head at one end thereof and a rod body at the other end thereof, wherein said rod body is inserted into said air flow channel via said closed opening, wherein said end head is located outside said closed opening, wherein said rod body has a base and an external threaded portion arranged thereon;

an adjusting assembly located in said air flow channel of said piston seat and connected between said rod body of said piston sleeve and said elastic plug block, wherein the adjusting assembly comprises an adjusting knob having an internal threaded portion and a locking seat for insertion of said rod body, wherein said external threaded portion of said rod body is threaded with said internal threaded portion of said adjusting knob, wherein a spring is provided and arranged between said locking seat and said base of said rod body, wherein one end of said adjusting knob is locked to said locking seat, so as to allow the rotating of said adjusting knob to change the relative locking position of said adjusting knob and said locking seat and to adjust the total length of said piston sleeve and said adjusting assembly.

2. The air flow adjusting device of air gun, as recited in claim 1, wherein said adjusting knob comprises a wiping portion arranged on the surface thereof, wherein said piston seat has at least one slot defined thereon corresponding to said wiping portion.

3. The air flow adjusting device of air gun, as recited in claim 2, wherein said adjusting knob has a plurality of concave teeth arranged thereon relative to an end surface of said locking seat, wherein said locking seat correspondingly has at least one protruding tooth engaged with said concave teeth to lock said adjusting knob in said locking seat, such that when said adjusting knob is rotated, said protruding tooth will be changed and engaged with different said concave teeth.

4. The air flow adjusting device of air gun, as recited in claim 3, wherein said locking seat has two symmetrical said protruding teeth.

* * * * *